United States Patent [19]

Stevens

[11] 4,375,356

[45] Mar. 1, 1983

[54] ARRANGEMENT FOR SUPPLYING AIR, FUEL, POWER AND CONTROL CABLES TO A MARINE PROPULSION UNIT

[75] Inventor: Myron T. Stevens, Kenosha, Wis.

[73] Assignee: Outboard Marine Corporation, Waukegan, Ill.

[21] Appl. No.: 190,387

[22] Filed: Sep. 24, 1980

[51] Int. Cl.[3] ..... B63H 5/06

[52] U.S. Cl. ..... 440/112; 440/900

[58] Field of Search ..... 440/49, 52, 53-66, 440/76, 77, 84, 85, 86, 87, 88, 112, 900

[56] References Cited

U.S. PATENT DOCUMENTS

| | | | |
|---|---|---|---|
| 1,511,867 | 10/1924 | Asbury | 440/55 |
| 2,235,140 | 3/1941 | Clarke | 440/900 |
| 3,161,173 | 12/1964 | Horan | 440/77 |
| 3,487,804 | 1/1970 | Kiekhaefer | 440/76 |
| 3,714,920 | 2/1973 | Setterblade | 440/61 |

*Primary Examiner*—Trygve M. Blix
*Assistant Examiner*—Jesús D. Sotello
*Attorney, Agent, or Firm*—Michael, Best & Friedrich

[57] ABSTRACT

Disclosed herein is a marine propulsion installation comprising a boat hull including a transom having therein an aperture, a propulsion unit including a powerhead compartment which is located aft of the transom, which includes a hollow interior housing an internal combustion engine, which is substantially closed, and which includes a forwardly located wall having therein an aperture, a bracket connecting the propulsion unit to the transom for pivotal movement relative thereto, a flexible boot sealingly connected to the transom and to the forwardly located wall and including a hollow interior in communication through the opening in the transom with the atmosphere forwardly of the transom and communicating through the aperture in the forwardly located wall with the interior of the powerhead compartment, and one or more flexible components extending from forwardly of the boat transom and through the interior of the boot to within the powerhead compartment, which components includes a fuel line, an electrical conductor, a hydraulic fluid line, and a mechanical cable.

6 Claims, 2 Drawing Figures

ARRANGEMENT FOR SUPPLYING AIR, FUEL, POWER AND CONTROL CABLES TO A MARINE PROPULSION UNIT

RELATED APPLICATION

Reference is hereby made to the co-pending Clarence E. Blanchard Application entitled "Mounting for Marine Propulsion Device Located Aft of Boat Transom", Ser. No. 188,323, filed Sept. 18, 1980.

BACKGROUND OF THE INVENTION

The invention relates generally to marine propulsion devices. More particularly, the invention relates generally to marine propulsion devices or units which, in whole or in part, are both tiltable and steerable relative to a supporting boat and which are substantially wholly carried aft of the boat transom.

In the past, outboard motors have included powerheads having covers with one or more openings permitting intake directly from the atmosphere of combustion air. Such intake openings also afforded the possibility of entry into the powerhead compartment of water in response to heavy rain or in response to heavy wave conditions.

Attention is directed to the Leipert U.S. Pat. No. 3,083,678 which discloses a marine propulsion device including a stationarily mounted powerhead and a steerable and tiltable gear case assembly.

Attention is also directed to the Kiekhaefer U.S. Pat. No. 3,487,804 issued Jan. 6, 1970, which discloses a stern drive unit including an air duct for delivering air into the slip stream of a propeller.

SUMMARY OF THE INVENTION

The invention provides a marine propulsion installation comprising a boat hull including a transom, a propulsion device including a powerhead compartment which is located aft of the transom, which has an interior housing an internal combustion engine, and which is substantially closed, a duct extending through the transom and including a hollow interior in communication with the atmosphere forwardly of the transom and with the interior of the powerhead compartment, and one or more of a group of flexible components extending from forwardly of the transom and through the transom to within the powerhead compartment, which group of flexible components includes a fuel line, an electrical conductor, a hydraulic fluid line, and a mechanical cable.

The invention also provides a marine propulsion installation comprising a boat hull including a transom having therein an aperture, a propulsion unit including a powerhead compartment which is located aft of the transom, which has an interior housing an internal combustion engine, which is substantially closed, and which includes a forwardly located wall having therein an aperture, means connecting the propulsion unit to the transom for pivotal movement relative thereto, and a flexible boot sealingly connected to the transom and to the forwardly located wall and including a hollow interior in communication through the opening in the transom with the atmosphere forwardly of the transom and communicating through the aperture in the forwardly located wall with the interior of the powerhead compartment.

In one embodiment of the invention, the marine propulsion installation further includes one or more of a group of flexible components extending from forwardly of the transom and through the interior of the boot to within the powerhead compartment, which group of flexible components includes a fuel line, an electrical conductor, a hydraulic fluid line, and a mechanical cable.

Other features and advantages of the embodiments of the invention will become known by reference to the following general description, claims and appended drawings.

THE DRAWINGS

Figure 1:
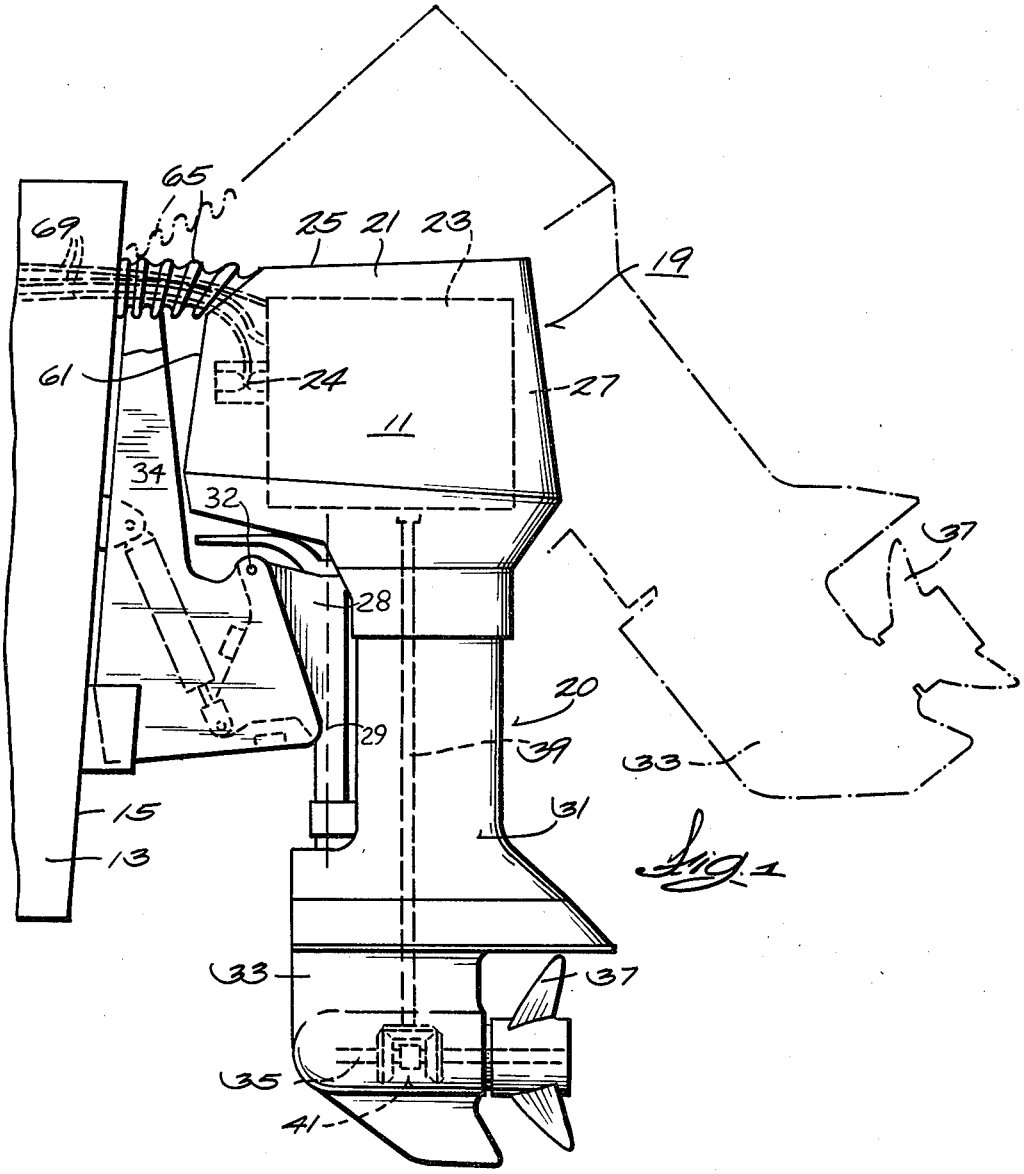
FIG. 1 is a partially schematic side elevational view of a marine propulsion installation incorporating various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 2:
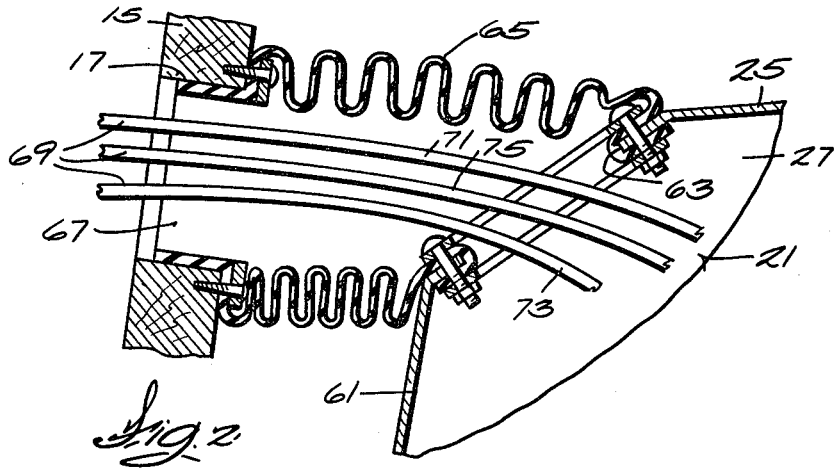
FIG. 2 is an enlarged view partially in section of a portion of the installation shown in FIG. 1.

Shown in the drawings is a marine installation 11 including a boat hull 13 having a transom 15 with an upper part including therein (see FIG. 2) an aperture 17. Suitably secured to the transom 15 and located rearwardly thereof is a marine propulsion device which can be in the form of an outboard motor 19 and which comprises a propulsion unit 20 including a powerhead 21 with an internal combustion engine 23 having a schematically shown throttle 24, together with a cover 25 which, in part, forms a substantially sealed powerhead compartment 27 enclosing the engine 23. While the cover 25 is preferably removably attached so as to afford access to the interior of the engine compartment 27, the cover 25 cooperates with other portions of the propulsion device so that the powerhead compartment 27 is substantially watertight.

The propulsion unit, as shown in the drawings, is secured to the transom and supported therefrom by a swivel bracket 28 so as to afford steering of the propulsion unit 20 relative to the swivel bracket 28 about a steering axis 29. In turn, the swivel bracket 28 is connected about a horizontal axis 32 to mounting means 34 which is adapted to be fixed to the transom 15. As illustrated, the horizontal axis 32 is located below the engine 23.

The propulsion unit 20 also includes a lower unit 31 which is rigidly connected to the bottom of the powerhead 21 and which includes, at the lower end thereof, a gear case section 33 including a rotatably mounted propeller shaft 35 carrying thereon a propulsion element, such as a propeller 37. The propeller shaft 35 is connected to a drive shaft 39 through a reversing transmission 41 and the drive shaft 39 extends upwardly through the lower unit 31 and is drivingly connected to the internal combustion engine 23.

The propulsion unit 20 can be arranged so that the powerhead 21 is relatively stationarily mounted aft of and with respect to the transom 15 and so that the lower unit 31 is both steerable and tiltable relative to the powerhead as shown, for instance, in the U.S. Blanchard Application entitled "Outboard Motor with Duel Tilt and Trim Axes", Ser. No. 167,337, filed July 9, 1980, which is incorporated herein by reference. Preferably, the powerhead 21 is located, so that when in the normal running position, the entire powerhead 21 is located below the top of the transom 15. Of course, at least some of the advantages of the invention can be secured when the powerhead 21 extends, in part, above the top of the transom 15. Preferably the arrangement is also such that the powerhead 21 remains entirely or substantially entirely behind the transom 15 during upward tilting movement.

In order to provide combustion air to within the substantially sealed powerhead compartment 27, to facilitate supply of fuel to the engine 23, as well as electrical energy, and to facilitate control and/or energy supply to one or more various mechanisms included in the propulsion unit, such as the engine throttle 24, the reversing transmission 41, a trim mechanism (not shown), a tilt mechanism, (not shown), a steering mechanism (not shown), and a starter mechanism (not shown), means are provided for affording communication between the interior of the boat hull 13 and the interior of the powerhead compartment 27 through the transom 15. While various arrangements can be employed, in the illustrated construction, such means comprises formation of the powerhead cover 25 with a forwardly located wall 61 having therein an aperture 63 and connection between the transom aperture 17 and the cover aperture 63 of a flexible boot or duct 65 having an interior which communicates both with the interior of the boat hull 13 forwardly of the transom 15 and with the interior of the powerhead compartment 27. Any suitable means can be provided for sealingly connecting the boot or duct 65 to the boat transom 15 around the opening 17 and to the forwardly located cover wall 61 around the opening 63 so as to exclude water, while permitting the desired communication between the interior of the boat hull 13 and the powerhead compartment 27 through the boot 65.

The forwardly located wall 61 can be flat or curved, and can be the front wall, or include a part of the top wall, or otherwise.

Extending into the duct 65 through an entrance opening 67 located forwardly of the rear of the transom 15 and through the duct or boot 65 to the engine compartment 27 are one or more flexible components 69 which serve to supply fuel to the engine 23, and/or control operation of the engine 23, and/or to supply power and/or control operation of one or more of the reversing mechanism 41, a steering mechanism (not shown), a tilt and/or trim mechanism (not shown), and/or a starting mechanism (not shown).

More specifically, the components 69 extending through the duct 65 can include a fuel supply line 71, a throttle control cable 73 which can be either mechanical or electrical, and one or more electrical and/or hydraulic conduits providing electrical and/or hydraulic power to the engine 23, and/or to an electric starting mechanism (not shown), and/or a hydraulic fluid pump (not shown). In addition, suitable electrical, hydraulic, or mechanical cables or lines can be used to supply electrical and/or hydraulic and/or mechanical power to, and to control any of, a steering mechanism, a power trim mechanism, a power tilt mechanism, and the reversing transmission 41. Of course, the duct 65 also supplies combustion air to the powerhead compartment 27 for the engine 23.

As a result of the above construction, the engine 23 can be operated in the substantial watertight compartment 27 aft of the transom 65 and various controls as well as combustion air and energy can be introduced into the powerhead compartment 27 without passage over the top of the transom 15 and without destroying the water-tight integrity of either the boat hull 13 or the powerhead compartment 27. In addition, the flexible nature of the boot 65 accommodates pivotal steering and tilting movements of the propulsion unit 20.

Various of the features of the invention are set forth in the following claims.

I claim:

1. A marine propulsion installation comprising a boat hull including a transom, a propulsion device including mounting means fixed to said transom, a bracket, means pivotally connecting said bracket to said mounting means about a horizontal axis, a propulsion unit including a powerhead compartment which is located aft of said transom, which has an interior housing an internal combustion engine located above said horizontal axis, and which is substantially closed, means pivotally connecting said propulsion unit to said bracket about an axis transverse to said horizontal axis, a duct extending through said transom and including a hollow interior in communication with the atmosphere forwardly of said transom and with the interior of said powerhead compartment, and one or more of a group of flexible components extending from forwardly of said transom and through said transom to within said powerhead compartment, said group of flexible components comprising a fuel line, an electrical conductor, a hydraulic fluid line, and a mechanical cable.

2. A marine propulsion installation comprising a boat hull including a transom having therein an opening, a marine propulsion device including mounting means fixed to said transom, a bracket, means pivotally connecting said bracket to said mounting means about a horizontal axis, a propulsion unit including a powerhead compartment which is located aft of said transom, which has an interior housing an internal combustion engine located above said horizontal axis, which is substantially closed, and which includes a forwardly located wall having therein an aperture, means connecting said propulsion unit to said bracket for steering pivotal movement relative thereto about an axis transverse to said horizontal axis, and a flexible boot sealingly connected to said transom and to said forwardly located wall and including a hollow interior in communication through said opening in said transom with the atmosphere forwardly of said transom and communicating through said aperture in said forwardly located wall with the interior of said powerhead compartment.

3. A marine propulsion installation in accordance with claim 2 and further including one or more of a group of flexible components extending from forwardly of said transom and through said interior of said boot to within said powerhead compartment, said group of flexible components comprising a fuel line, an electrical conductor, a hydraulic fluid line, and a mechanical cable.

4. A marine propulsion installation comprising a boat hull including a transom, a propulsion device including a powerhead compartment which is located aft of said transom, which has an interior housing an internal combustion engine, and which is substantially closed, a duct extending through said transom and including a hollow interior in communication with the atmosphere forwardly of said transom and with the interior of said powerhead compartment, and one or more of a group of flexible components extending from forwardly of said transom and through said duct to within said powerhead compartment, said group of flexible components comprising a fuel line, an electrical conductor, a hydraulic fluid line, and a mechanical cable.

5. A marine propulsion installation comprising a boat hull including a transom having therein an opening, a propulsion unit including a powerhead compartment which is located aft of said transom, which has an interior housing an internal combustion engine, which is substantially closed, and which includes a forwardly located wall having therein an aperture, means connecting said propulsion unit to said transom for pivotal movement relative thereto, a flexible boot sealingly connected to said transom and to said forwardly located wall and including a hollow interior in communication through said opening in said transom with the atmosphere forwardly of said transom and communicating through said aperture in said forwardly located wall with the interior of said powerhead compartment, and one or more of a group of flexible components extending from forwardly of said transom and through said interior of said boot to within said powerhead compartment, said group of flexible components comprising a fuel line, an electrical conductor, a hydraulic fluid line, and a mechanical cable.

6. A marine propulsion installation comprising a boat hull including a transom, a propulsion device including mounting means fixed to said transom, a bracket, means pivotally connecting said bracket to said mounting means about a horizontal axis, a lower unit, means pivotally connecting said lower unit to said bracket for vertical swinging movement about an axis transverse to said horizontal axis, a powerhead including a compartment which is located aft of said transom and above said lower unit, which is substantially closed, and which has an interior housing an internal combustion engine located above said horizontal axis and connected to said lower unit, a duct extending through said transom and including a hollow interior in communication with the atmosphere forwardly of said transom and with the interior of said powerhead compartment, and one or more of a group of flexible components extending from forwardly of said transom and through said transom to within said powerhead compartment, said group of flexible components comprising a fuel line, an electrical conductor, a hydraulic fluid line, and a mechanical cable.

* * * * *